United States Patent [19]

Nishikawa et al.

[11] 4,094,064

[45] June 13, 1978

[54] SHEARING TOOL FOR SYNTHETIC RESIN TUBES

[75] Inventors: Hideichi Nishikawa; Masaharu Sakamoto, both of Tsu, Japan

[73] Assignee: Matsuzaka Iron Works, Inc., Tsu, Japan

[21] Appl. No.: 787,577

[22] Filed: Apr. 14, 1977

[30] Foreign Application Priority Data

Apr. 16, 1976 Japan ..... 51-48576[U]
Dec. 9, 1976 Japan ..... 51-164945[U]

[51] Int. Cl.[2] ..... B26B 13/00
[52] U.S. Cl. ..... 30/92; 30/192; 30/251
[58] Field of Search ..... 30/92, 192, 251, 252; 81/181, 182

[56] References Cited

U.S. PATENT DOCUMENTS

| | | | |
|---|---|---|---|
| 3,273,240 | 9/1966 | Florian | 30/192 |
| 3,390,455 | 7/1968 | Florian | 30/251 |
| 3,587,173 | 6/1971 | Hexdall | 30/251 |

*Primary Examiner*—Robert C. Watson

*Attorney, Agent, or Firm*—McNenny, Pearne, Gordon, Gail, Dickinson & Schiller

[57] ABSTRACT

A shearing tool for synthetic resin tubes in which a lower jaw is connected to the leading end of an upper handle portion, a lower handle portion is pivoted at the leading end to the rear and lower end of said lower jaw, an upper jaw or shearing blade having a cutting edge is pivoted in an intermediate position to said upper handle portion above the pivot connection of said lower jaw to said lower handle portion, said lower jaw is provided with an arcuate tube receiving recess in the upper surface thereof, an opening is provided in forward portion of said upper handle portion extending therefrom to the leading end of said lower jaw for receiving said upper jaw, a connection link is connected between the rear end portion of said blade interposed between said upper and lower handle portions and the lower handle portion in a position rearwardly of said pivot connection of the lower jaw to said lower handle portion for urging said cutting edge toward said tube receiving recess when said upper and lower handle portions are pivoted toward each other and a spring is provided for normally urging said upper and lower handle portions away from each other when said tool is in its non-operative position.

2 Claims, 5 Drawing Figures

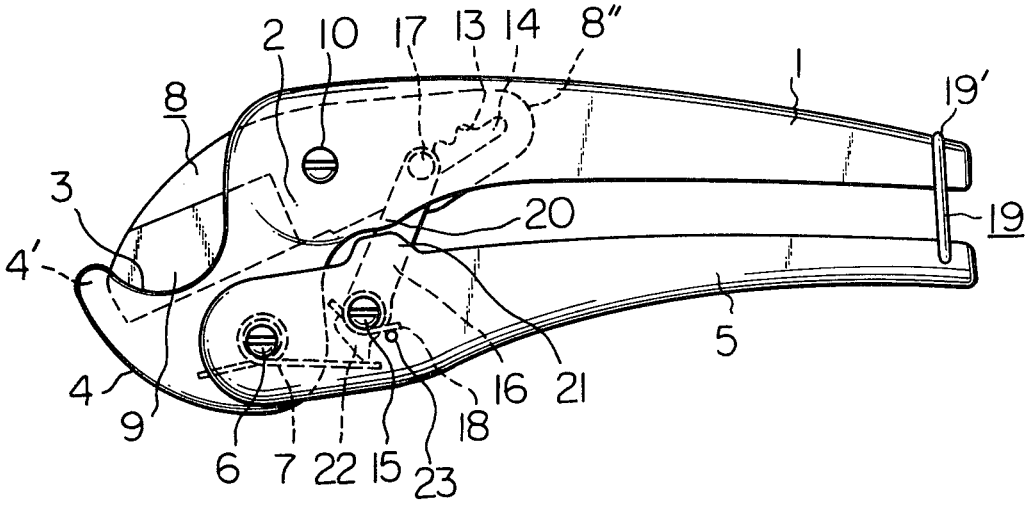

SHEARING TOOL FOR SYNTHETIC RESIN TUBES

BACKGROUND OF THE INVENTION

This invention relates to a shearing tool for synthetic resin tubes such as hard vinyl chloride tubes and hard vinyl conduit tubes.

Synthetic resin tubes were hithertofore sheared by a saw, but such shearing operation by the saw required rather long time and much labor and the cut face produced in the sheared tube by the saw shearing was unsatisfactory to the degree that it required trimming or elaborate finish and thus, the shearing of the synthetic resin tube by the saw was inefficient. Alternatively, although various shearing tools in the form of scissors for synthetic resin tubes have been proposed and practically employed, such prior art shearing tools have the following inherent disadvantages:

1. During the shearing operation, the tube can not be supported in a stabilized state and therefore, the shearing operation is difficult and can not produce a satisfactory or precise cut face and as a result, it requires an additional step for trimming or elaborate finishing the cut face.

2. A great deal of manual effort or gripping force is required to produce a powerful and sufficient shearing force.

3. Since the tube is not suitably supported, the tube tends to easily crack and/or break.

4. A positive and precise shearing action can not be obtained easily and a highly skilled hand is required for the purpose.

SUMMARY OF THE INVENTION

Therefore, one object of the present invention is to provide an improved shearing tool for synthetic resin tubes whereby a synthetic resin tube is held in a stabilized state during the shearing of the tube, the shearing operation is performed in a simple manner and a satisfactory and precise cut face can be produced in the sheared tube.

Another object of the present invention is to provide a shearing tool for synthetic resin tubes whereby a powerful and sufficient shearing force can be easily obtained with a minimum manual effort or gripping force.

Another object of the present invention is to provide a shearing tool for synthetic resin tubes whereby the possibility of the cracking and/or breakage of the tube during the shearing of the tube can be effectively obviated.

Another object of the present invention is to provide a shearing tool for synthetic resin tubes whereby a positive shearing action can be easily obtained and as a result, the tube can be easily sheared without requiring any skilled hand.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

Figure 1:
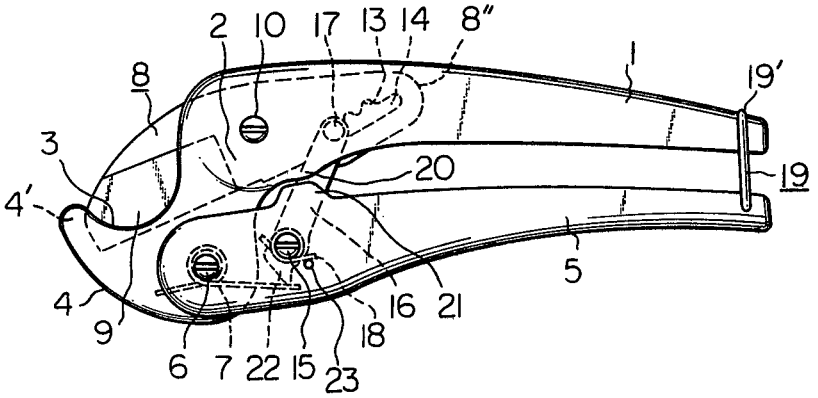
FIG. 1 is a side elevational view of one preferred embodiment of shearing tool for synthetic resin tubes constructed in accordance with the present invention showing the tool in its non-operative position.
Figure 2:
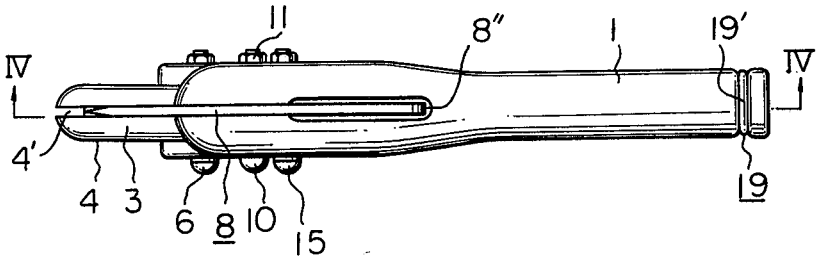
FIG. 2 is a plan view of the shearing tool shown in FIG. 1.
Figure 3:
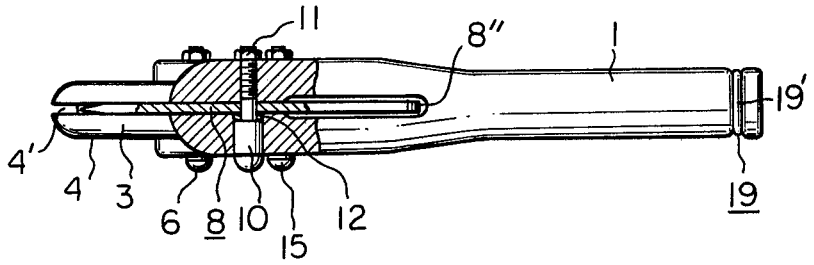
FIG. 3 is a plan view of said shearing tool with a portion thereof broken away to show the connection between the shearing blade and the upper handle.

The present invention will be now described referring to the accompanying drawings and more particularly, to FIG. 1 thereof. The shearing tool of the invention generally comprises a handle including an upper handle portion 1 and a lower handle portion 5. The upper handle portion has an integral lower jaw 4 formed at the leading end of the handle portion and the lower jaw 4 has an arcuate tube receiving recess 3 in the upper surface thereof. The upper handle portion 1 further has an opening 4' extending from the forward portion of the handle portion to the leading end of the lower jaw 4 for the purpose to be described hereinafter. The leading end of the lower handle portion 5 is pivoted to the lower and rear end of the lower jaw 4 by means of a pivot pin 6. A return spring 7 is disposed about the pivot pin 6 with the opposite ends of the spring abutting against the lower jaw 4 and lower handle portion 5 for urging the lower handle portion to the initial or normal position in which the lower handle portion assumes when no manual effort or gripping force is applied thereto. A shearing blade or upper jaw 8 is received in the opening 4' and pivoted in an intermediate portion of the blade to the leading end of the upper handle portion 1 by means of a bolt 10. A friction washer 12 is also disposed within the opening 4' about the bolt 10 in abutment against the side of the blade 8 to frictionally hold the blade in position. The rear portion of the shearing blade 8 positioned between the upper and lower handle portions 1, 5 is provided with a guide slot 14 the upper side edge of which is formed with a series of notches 13 and the lower side edge of which is planner. A rocking bar 16 is pivoted at the lower end to the leading end of the lower handle portion 5 by means of a pivot pin 15 and has at the other end a pin 17 freely received in the guide slot 14. A spring 18 is disposed about the pivot pin 15 with one end of the spring abutting against the rocking bar 16 and the other end of the same abutting against an engaging pin 23 provided on the lower handle portion 5 in a position adjacent to the pivot pin 15 to urge the pin 17 to selectively engage the series of notches 13. The upper handle portion 1 and lower jaw 5 are connected together by means of an intermediate neck portion 2 integral with the upper handle portion 1. The shearing blade or upper jaw 8 has a downwardly directed cutting edge 9 along the lower edge of the front portion of the blade. Reference numeral 11 denotes a nut threaded on the bolt 10 and reference numeral 19 denotes a U-shaped stopper having a pair of opposite legs pivoted to the rear end of the lower handle portion 5 and a cross member 19' connecting the legs together. When the shearing tool is in its non-operative position as shown in FIG. 1, the stopper 19 is fitted on the rear end of the upper handle portion 1 with the cross member 19' positioned on the upper surface of the upper handle portion 1 as shown in FIG. 1 so that both the handle portions 1, 5 are prevented from inadvertently moving away from each other when the tool is in its inoperative position. The guide slot 14 is disposed in an inclination with respect to the longitudinal axis of the cutting edge 9 in the counter-clockwise direction so that the pivotal movement amount of the cutting edge 9 becomes greater than that of the lower handle portion 5 whereby a positive and sufficient shearing force can be obtained even when the handle portions are operated with a small distance by each other.

Reference numerals 20, 21 denote bulges or stoppers formed on the lower surface of the upper handle portion 1 and the upper surface of the lower handle portion 5, respectively, in opposing relationship for limiting the relative pivotal movement of the two handle portions toward each other. The rocking bar 16 further has a rotation regulation stopper 22 provided at the lower end for abutting against the engaging pin 23 near the pivot pin 15 which pivotally connects the rocking bar 16 to the lower handle portion 5 so as to regulate the pivotal movement of the rocking bar 16 in the return direction. In order to reduce the weight of the handle portions 1, 5, the handle portions are advantageously fabricated from aluminum or other light metal members having a U-shaped cross-section.

Figure 4A:
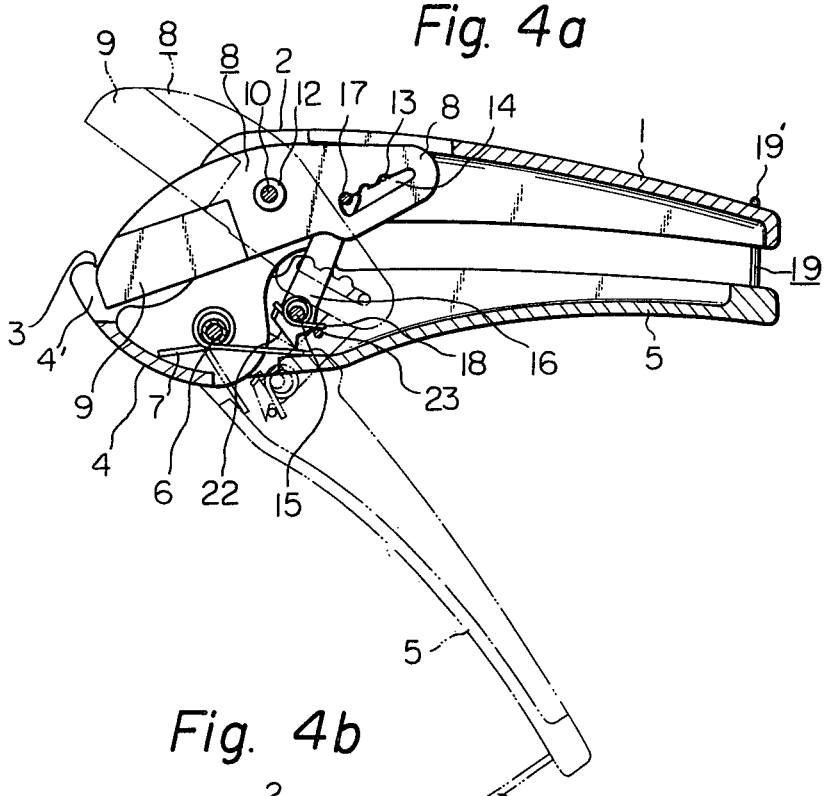
FIG. 4*a* is a sectional view taken along the line IV—IV of FIG. 2 showing the tool in the non-operative closed position by the full lines and in operative open position by the two-dot chain lines, respectively.
Figure 4B:
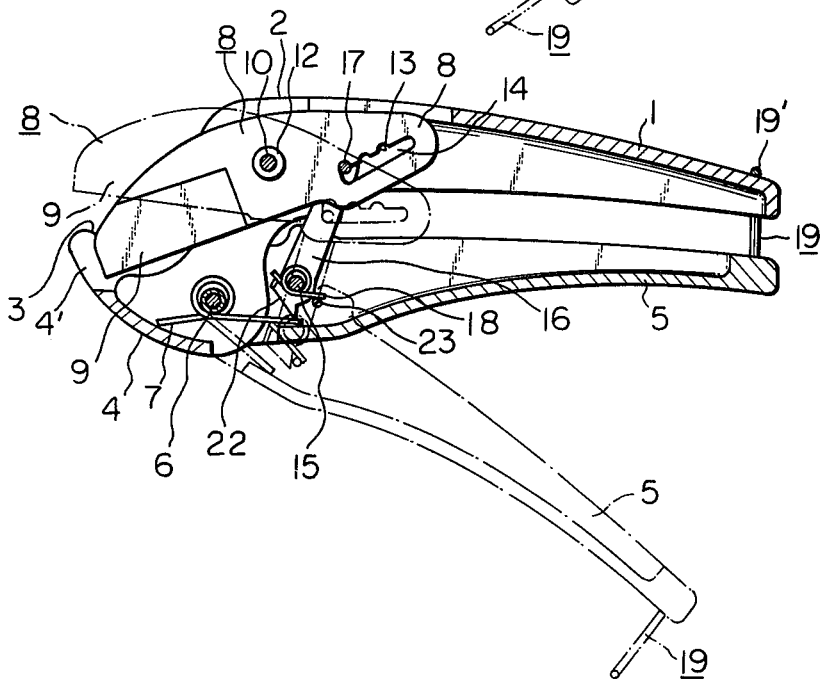
FIG. 4*b* is a similar view to FIG. 4*a* but showing the tool in different operative position by the one-dot chain line.

In operation, first of all, the stopper 19 is disengaged from the upper handle portion 1 and the upper handle portion 1 is gripped by one hand of the operator and the lower handle portion 5 is gripped by the other hand of the operator. Then, when the lower handle portion 5 is pulled downwardly from the full line position as shown in FIG. 4*a*, the lower handle portion 5 is caused to pivot in the clockwise direction about the pivot pin 6, by means of which the leading end of the handle portion is pivoted to the lower end of the lower jaw 4, with the aid of the resiliency of the return spring 7. Simultaneously, the shearing blade 8, which is now held against rotation by the bolt 10, nut 11 and washer 12 within the neck portion 2 of the upper handle portion 1, also pivots about the bolt 10 in the clockwise direction against the frictional force of the bolt 10, nut 11 and washer 12, because the pin 17 at the upper end of the rocking bar 16 pivoted to the lower handle portion 5 engages in the guide slot 14 in the rear end portion 8″ of the shearing blade 8. As a result, the cutting edge 9 of the shearing blade 8 is moved upwardly from the full line position to the two-dot line position away from the arcuate tube receiving recess 3 in the lower jaw 4 as seen in FIG. 4*a*. Thereafter, a synthetic resin tube such as a hard vinyl chloride tube is inserted in the recess 3 and then the upper and lower handle portions 1, 5 are gradually tightened toward each other. As the two handle portions 1, 5 are tightened in this way, the lower handle portion 5 is pivoted upwardly about the pivot pin 6 in the counterclockwise direction against the resiliency of the return spring 7 wound about the pin 6 and at the same time, the rocking bar 16 pivoted to the leading end of the lower handle portion 5 at 15 also pivots upwardly in the counterclockwise direction. Since the pin 17 on the rocking bar 16 engages in the outermost notch 13 of the slot 14 in the shearing blade 8 at this time, the pin 17 pushes the rear end portion of the shearing blade 8 upwardly whereby the shearing blade 8 is pivoted about the bolt 10 in the counterclockwise direction against the friction force of the friction washer 12. As a result, the cutting edge 9 in the front part of the blade 8 rotates downwardly toward the lower jaw 4 to cut in the synthetic tube received in the recess 3. At the same time, since the pin 17 is subjected to the reaction force from the notch 12 in which the pin now engages, the rocking bar 16 pivots about the pivot pin 15 in the clockwise direction against the resiliency of the return spring 18 wound about the pin 15 to thereby complete the initial stage of the tube shearing operation. At the completion of the initial stage of the shearing operation, when the upper and lower handle portions 1, 5 are released slightly, the lower handle portion 5 pivots downwardly about the pin 6 in the clockwise direction with the aid of the return spring 7 and as a result, the rocking bar 16 pivoted to the lower handle portion 5 at 15 pivots downwardly or in the counterclockwise direction with the aid of the return spring 18. In such a case, although the front part of the shearing blade 8 tends to pivot upwardly about the bolt 10 under the repulsion of the synthetic resin tube, the front part of the shearing blade 8 is held in the lowered position by the friction washer 12 on the bolt 10. Therefore, as the lower handle portion 5 pivots downwardly under the action of the return spring 7, the distance from the pivot pin 15 to the outermost notch 13 becomes greater than the distance from the pivot pin 15 to the pin 17 on the rocking bar 16 whereupon the pin 17 disengages from the now engaging notch. When the pin 17 disengages from the particular notch 13, the rocking bar 16 pivots in the counterclockwise direction by the action of the return spring 18 as mentioned hereinabove and the pin 17 on the bar then engages the second outermost notch 13 next to the outermost notch 13. By repeating the above-mentioned sequence of shearing operation with the pin 17 engaging in the second outermost notch next to the outermost notch, the pin 17 successively engages the successively inward notches and the cutting edge 9 of the shearing blade 8 moves downwardly step by step until the cutting edge bodily enters the tube receiving recess 3 as shown by the full lines in FIG. 4*a* or 4*b* to thereby completely shear the tube.

In the embodiment illustrated, although the friction washer 12 is interposed between the head of the bolt 10 and the shearing blade 8, it is also possible that the position of the washer is reversed within the scope of the invention. As mentioned hereinabove, when the washer 12 is interposed between the shearing blade 8 and the head of the bolt 10, a suitable friction force is produced to control the movement of the blade 8 in the return direction and positively advance the pin 17 inwardly to engage the successively inward notches. Thus, the friction washer is preferably a spring washer and the friction force of the washer can be adjusted by tightening or loosening the bolt 10 and nut 11.

As mentioned hereinabove, according to the present invention, since the lower jaw is provided in the upper surface with the arcuate tube receiving recess, the synthetic resin tube can be held in position without deforming during the shearing operation on the tube and thus, the shearing operation can be easily performed. And the shearing blade is guided along the opening provided through the full length and height of the lower jaw from the top to the bottom of the tube to shear the tube in the recess vertically and thus, the synthetic resin tube can be precisely sheared without tilting and the produced cut face is exactly normal to the longitudinal axis of the synthetic resin tube and very fine which does not require any trimming or finish after the shearing.

Further, according to the present invention, since the synthetic resin tube is supported in the tube receiving recess on both sides of the blade and small cutting speed can be obtained in the beginning of the shearing operation, the synthetic resin tube can be sheared without cracking.

Furthermore, according to the present invention, the rear portion of the shearing blade is provided with a notched guide slot at an angle with respect to the longitudinal axis of the cutting edge and the pin on the spring-loaded rocking bar pivoted to the lower handle portion engages in the guide slot. Thus, as the upper and lower handle portions are repeatedly opened or closed or moved away from and toward each other, the pin successively engages the successively inwardly positioned notches to shear the synthetic resin tube step by step. Therefore, with the shearing tool of the invention, a positive and sufficient shearing can be performed with a slight manual effort even by one hand and the tube shearing can be easily performed. In addition, the shearing blade is held in position with a suitable friction force of the friction washer by tightening the nut and thus, the blade is held against movement even when the handle is in its open position whereby the pin can be positively advanced from one notch to another notch and the shearing operation can be smoothly and promptly performed without requiring any highly skilled hand.

While only one embodiment of the invention has been shown and described in detail it will be understood that the same is for illustration purpose only and not to be taken as a definition of the invention, reference being had for this purpose to the appended claims.

What is claimed is:

1. In a shearing tool for synthetic resin tubes comprising:

an upper handle portion;

a lower jaw connected to the leading end of said upper handle portion by means of an intermediate neck portion integral with the upper handle portion, said upper handle portion being formed with an opening extending from the forward portion of said handle portion to the leading end of the lower jaw;

a lower handle portion pivoted at the leading end to said lower jaw;

a shearing blade pivoted to said upper handle portion withing said opening, said shearing blade being formed at the rear portion positioned between said upper and lower handle portions with a guide slot, said guide slot including a series of notches along one side edge of the slot and a planer side edge along the opposite or other side edge of the slot;

a rocking bar pivoted at one end to the lower handle portion and including at the other end of the rocking bar a pin freely received in said guide slot for selectively engaging said series of notches formed on the slot, said rocking bar being adapted to urge said shearing blade toward said lower jaw when said upper and lower handle portions are pivoted toward each other by a gripping force applied to the handle portions;

a spring for urging said pin to engage in said series of notches;

a return spring for urging said lower handle portion away from said upper handle portion to the initial position when said gripping force is released from the upper and lower handle portions;

a friction washer provided about said pivot connection of said shearing blade to said upper handle portion within said opening for applying friction force to the side of the blade so as to hold the blade in position; and a pin provided on said lower handle portion for engaging said rocking bar so as to stop the bar against rocking; characterized in that said pivoting of said shearing blade to said upper handle portion is in an intermediate position of the length of said blade, said planar side edge of the guide slot formed in the blade being disposed in an inclination with respect to the cutting edge of said shearing blade in the counterclockwise direction, said upper and lower handle portions being fabricated from light metal having a U-shaped cross-section, both of said rear portions of said shearing blade and said rocking bar being disposed between two walls of U-shaped cross-section of said handle portions, said lower jaw being formed with an arcuate tube receiving recess on the upper surface of the jaw, and thereby the user being able to shear said tubes by applying gripping force with one hand to the handle portions.

2. The shearing tool as set forth in claim 1, in which said return spring is disposed adjacent the leading end of said lower handle portion and substantially enclosed within said U-shaped cross-sections of said upper and lower handle portions.

* * * * *